US005478979A

United States Patent [19]

Castonguay et al.

[11] Patent Number: 5,478,979

[45] Date of Patent: Dec. 26, 1995

[54] CIRCUIT BREAKER CLOSING AND OPENING INTERLOCK ASSEMBLY

[75] Inventors: Roger N. Castonguay, Terryville; James L. Rosen, West Hartford; Mark A. Zaffetti, Windsor Locks, all of Conn.

[73] Assignee: General Electric Company, New York, N.Y.

[21] Appl. No.: 225,385

[22] Filed: Apr. 8, 1994

[51] Int. Cl.[6] ..... H01H 5/00

[52] U.S. Cl. ..... 200/400

[58] Field of Search ..... 200/400

[56] References Cited

U.S. PATENT DOCUMENTS

| | | | |
|---|---|---|---|
| 2,581,181 | 1/1952 | Favre . | |
| 3,652,815 | 3/1972 | Davies | 200/400 |
| 4,001,742 | 1/1977 | Jencks et al. | 335/173 |
| 4,800,242 | 1/1989 | Yin | 200/400 |
| 4,801,907 | 1/1989 | Kelaita, Jr. et al. | 335/20 |

OTHER PUBLICATIONS

Castonguay et al; USSN: 203,062 for "Rating Module Unit for High Ampere–Rated Circuit Breaker" filed Feb. 28, 1994.

Castonguay et al, USSN: 218,287 for "A Latching Arrangement for High Ampere–Rated Circuit Breaker Operating Springs" filed Mar. 28, 1994.

U.S. Ser. No: 202,140 filed Feb. 25, 1994, Castonguay et al.

U.S. Ser. No. 205,240 filed Mar. 3, 1994, Castonguay et al.

U.S. Ser. No. 214,522 filed Mar. 18, 1994, Castonguay et al.

*Primary Examiner*—Renee S. Luebke

*Attorney, Agent, or Firm*—Richard A. Menelly

[57] ABSTRACT

This invention relates to a high ampere-rated circuit breaker which meets the electrical code requirements of the world market. The closing springs controlling the CLOSED state and the opening springs controlling the OPENED state of the circuit breaker contacts are interlocked to prevent operation of both springs at the same time. The closing lever and the opening lever interact in such a manner that only one of the levers can release the associated closing or opening springs.

5 Claims, 5 Drawing Sheets

CIRCUIT BREAKER CLOSING AND OPENING INTERLOCK ASSEMBLY

BACKGROUND OF THE INVENTION

U.S. Pat. No. 4,001,742 entitled "Circuit Breaker Having Improved Operating Mechanism" describes a circuit breaker capable of interrupting several thousand amperes of circuit current at several hundred volts potential. As described therein, the operating mechanism is in the form of a pair of powerful operating springs that are restrained from separating the circuit breaker contacts by means of a latching system. Once the operating mechanism has responded to separate the contacts, the operating springs must be recharged to supply sufficient motive force to the movable contact arms that carry the contacts.

U.S. Patent Application entitled "Operating mechanism for high ampere-rated circuit breaker" application Ser. No. 08/202,140 filed Feb. 25, 1994, describes an operating mechanism capable of immediately resetting the circuit breaker operating mechanism to reclose the contacts without having to recharge the circuit breaker operating springs immediately after opening the circuit breaker contacts.

U.S. Patent Application entitled "Rating module unit for high ampere-rated circuit breaker" application Ser. No. 08/203,062 filed Feb. 28, 1994, describes a circuit breaker closing spring modular unit whereby the circuit breaker operating springs are contained within a separate unit from the operating mechanism and can be installed within the circuit breaker enclosure without disturbing the operating mechanism assembly, U.S. Patent Application entitled "Handle operator assembly for high ampere-rated circuit breaker" (41PR-7130) describes a handle operator unit capable of generating large spring charging forces by means of an externally-accessible manually operated handle. A ratchet and pawl assembly allows the manually-applied charging forces to be applied to the operating springs. Once the circuit breaker operating mechanism closing springs are fully-charged, some means must be employed to release the pawl to allow the closing springs to become fully operational.

The charging of the powerful operating springs controlling the circuit breaker contacts is made manually by means of a ratchet and pawl assembly. A two stage latching arrangement controls the retention and release of the pawl to retain and discharge the operating springs as described in U.S. Patent Application entitled "Latching arrangement for high ampere-rated circuit breaker operating springs" application Ser. No. 08/218,287 filed Mar. 28, 1994.

Since separate pairs of operating springs are used to close and to open the circuit breaker contacts, it is important to prevent any attempt to close and open the circuit breaker contacts simultaneously.

Prior attempts to discourage depressing the closing and opening buttons that were externally accessible included remotely positioning the buttons from each other on the circuit breaker cover. However, with the streamlined operating mechanism described within the aforementioned U.S. Patent Applications, the operating mechanism components interact with the accessories that are mounted within the circuit breaker cover next to the electronic trip unit. To efficiently couple the operating mechanism components with the accessories and with the electronic trip unit, it is preferable to arrange the closing and opening buttons alongside each other.

One purpose of the invention is to provide an interlock arrangement between the closing and opening components that responds to the closing and opening buttons that will reliably prevent both buttons from being operated simultaneously.

SUMMARY OF THE INVENTION

The opening and closing systems for the opening and closing springs for the circuit breaker contacts are interlocked to prevent both systems from being operated at the same time. The opening lever and closing lever within the associated systems interact through abutting surfaces. The first lever to respond moves away from the abutting surfaces allowing the associated opening or closing springs to respond. Simultaneous operation of the opening and closing buttons prevents both levers from responding.

DESCRIPTION OF THE PREFERRED EMBODIMENT

Figure 1:
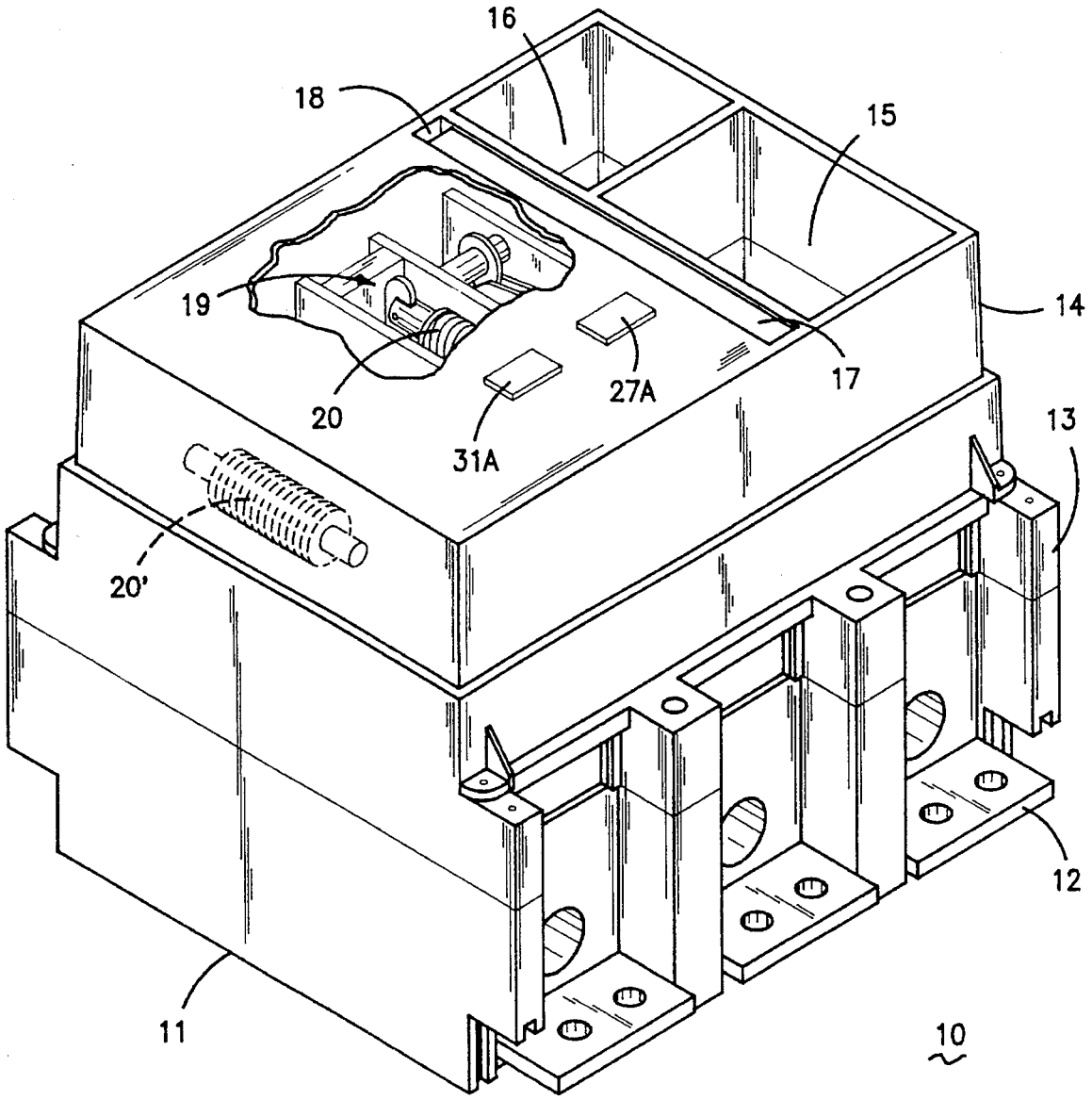
FIG. 1 is a top perspective view of a high ampere-rated circuit breaker with a portion of the circuit breaker cover removed to depict the circuit breaker operating mechanism.
Figure 2:
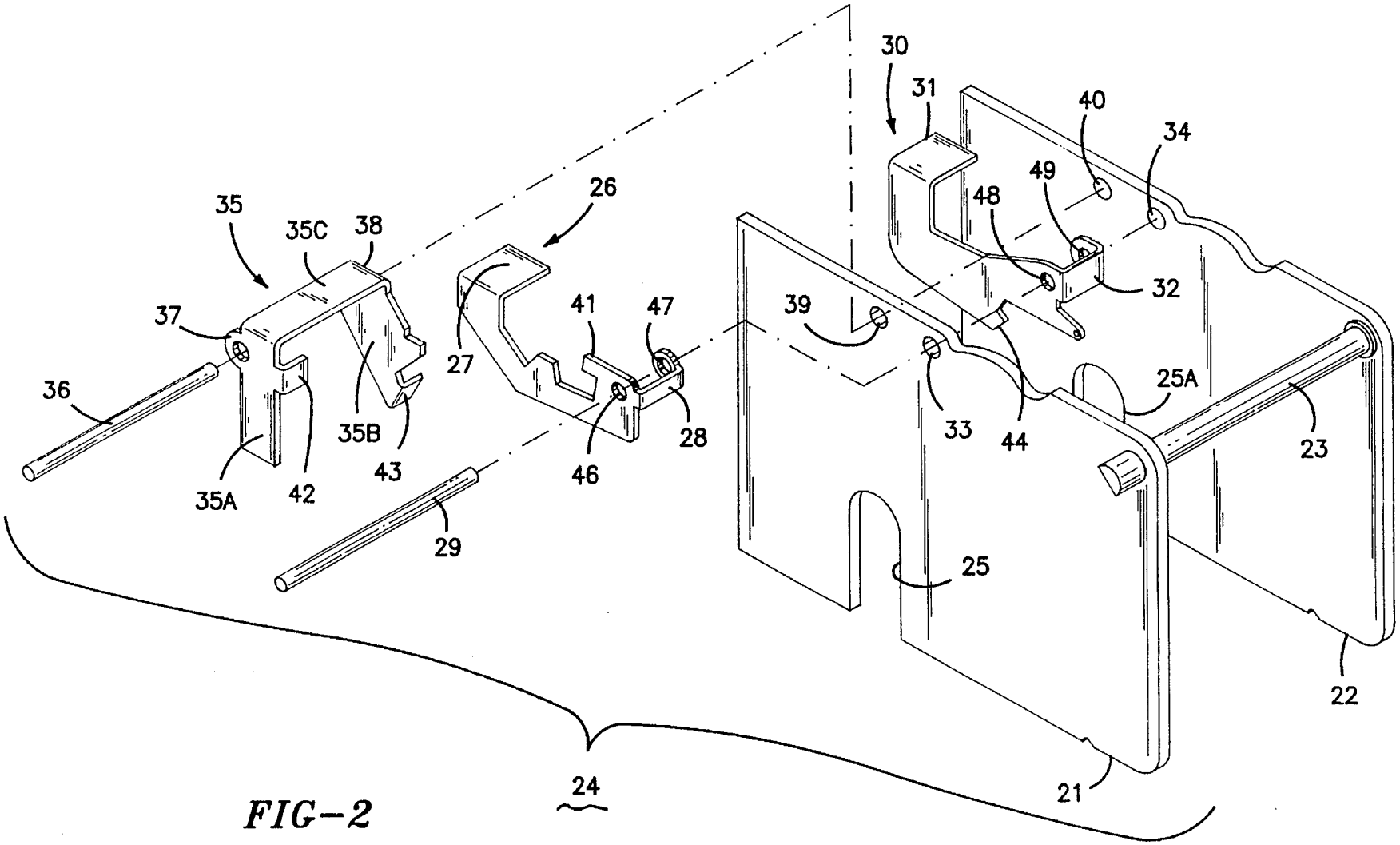
FIG. 2 is a top perspective view of the externally-accessible interlock assembly used within the circuit breaker operating mechanism of FIG. 1.

The high ampere-rated circuit breaker 10 shown in FIG. 1 is capable of transferring several thousand amperes quiescent circuit current at several hundred volts potential without overheating. The circuit breaker consists of an electrically insulated base 11 to which an intermediate cover 13 of similar insulative material is attached prior to attaching the top cover 14, also consisting of an electrically-insulative material. Electrical connection with the interior current-carrying components is made by load terminal straps 12 extending from one side of the base and line terminal straps (not shown) extending from the opposite side thereof. The interior components are controlled by an electronic trip unit contained within a recess 15 on the top surface of the top cover 14. Although not shown herein, the trip unit is similar to that described within U.S. Pat. No. 2,581,181 and interacts further with an accessory contained within the accessory recess 16 to provide a range of protection and control functions such as described, for example within U.S. Pat. No. 4,801,907. The operating handle 17 located within the handle recess 18 allows manual operation of the circuit breaker operating mechanism to open and close the circuit breaker contacts by means of the powerful closing and opening springs 20, 20'. The externally-accessible closing button 27A and the externally-accessible opening button 31A contact and depress the associated closing tab 27 and opening tab 31 within the interlock assembly 24 best seen by now referring to FIG. 2.

Figure 3:
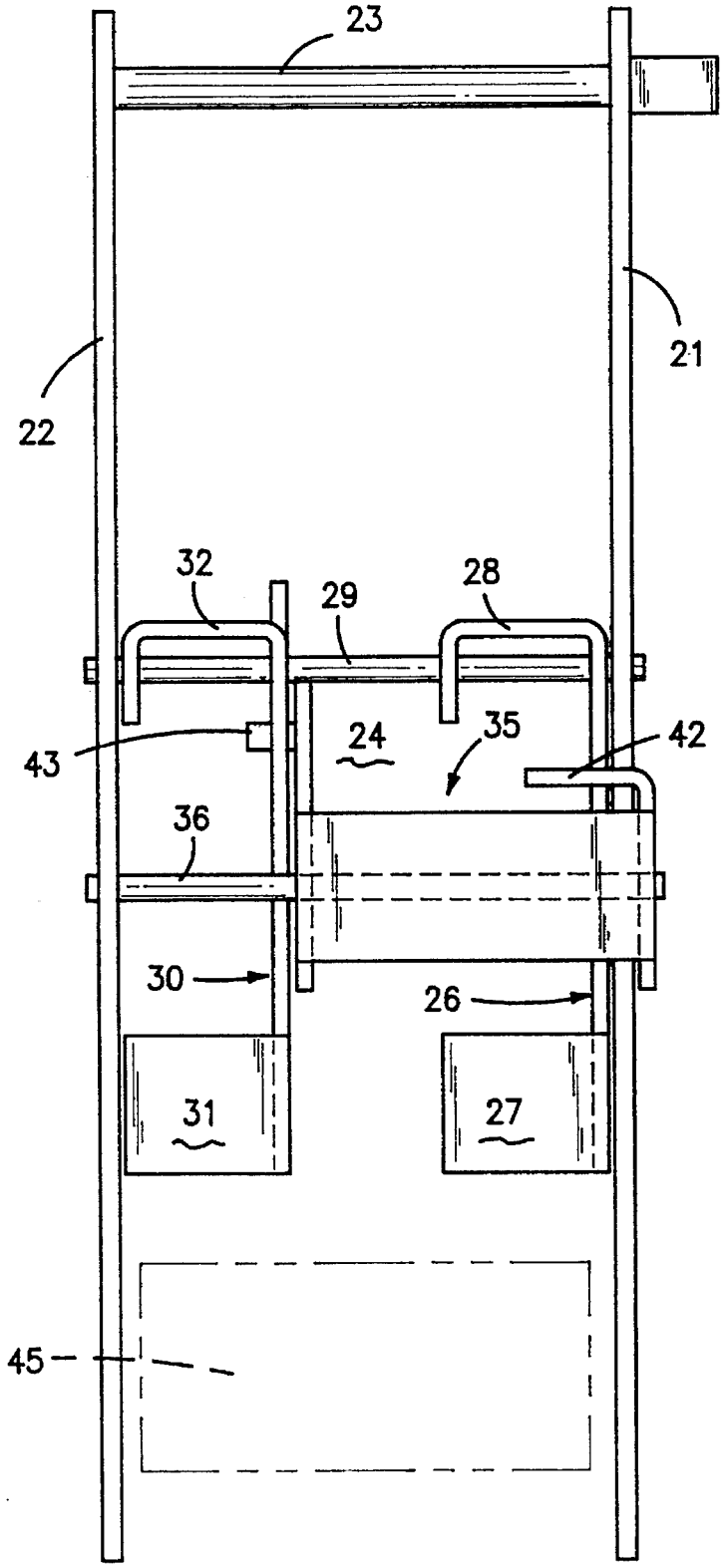
FIG. 3 is a top plan view of the circuit breaker of FIG. 1 with the top cover removed to depict the externally-accessible interlock assembly according to the invention.

The interlock assembly 24 is supported by the operating mechanism sideframe 21, 22 next to the closing latch 23 which functions in the manner described within aforementioned U.S. Pat. No. Ser. No. 08/218,287 filed Mar. 28, 1994. The interlock assembly 24 is positioned above the drive shaft, which although not shown, is received within the drive shaft slots 25 and 25A which extends between the sideframes. The closing lever 26 is formed from a single metal piece to define the closing tab 27 at one end and U-shaped pivot support 28 at an opposite end. The projection 41 extending from the inner part of the support 28 interacts with the interlock tab 42 extending from one leg 35A on the interlock link 35 in the manner to be described below in some detail. The interlock link 35 is formed from a single metal piece to define a U-shaped configuration having two legs 35A, 35B connected by a bight 35C. A pair of thru-holes 37, 38 formed at opposite ends of the bight receive the closing link pivot shaft 36 which positions and supports the closing link between the sideframes 21, 22 by means of openings 39, 40. The opening lever 30 is formed from a single metal piece to define the opening tab 31 at one end and U-shaped pivot support 32 at an opposite end. The projection 44 extending from the bottom of the support 32 interacts with the interlock tab 43 extending from the other leg 35B on the interlock link 35 in the manner to be described below in some detail. The common pivot 29 extends through the thru-holes 46–49 formed within the closing lever 26 and opening lever 30 and the openings 33, 34 formed in the sideframes 21, 22 to position the closing lever 26 and opening lever 30 side-by-side as shown in FIG. 3.

The interlock assembly 24 is assembled between the sideframes 21, 22 and is positioned between the closing latch 23 and the latching system 45 depicted in phantom, as described in the aforementioned patent application Ser. No. 08/205,240 filed Mar. 3, 1994. The interlock link 35 supported on the pivot shaft 36 locates the interlock tabs 42, 43 in line with the closing lever 26 and opening lever 30 to insure interlock function between the closing and opening levers when the closing tab 27 and the opening tab 31 are simultaneously depressed and the closing and opening levers attempt to rotate about the common pivot 29 extending through the U-shaped pivot supports 28, 32 respectively.

Figure 4:
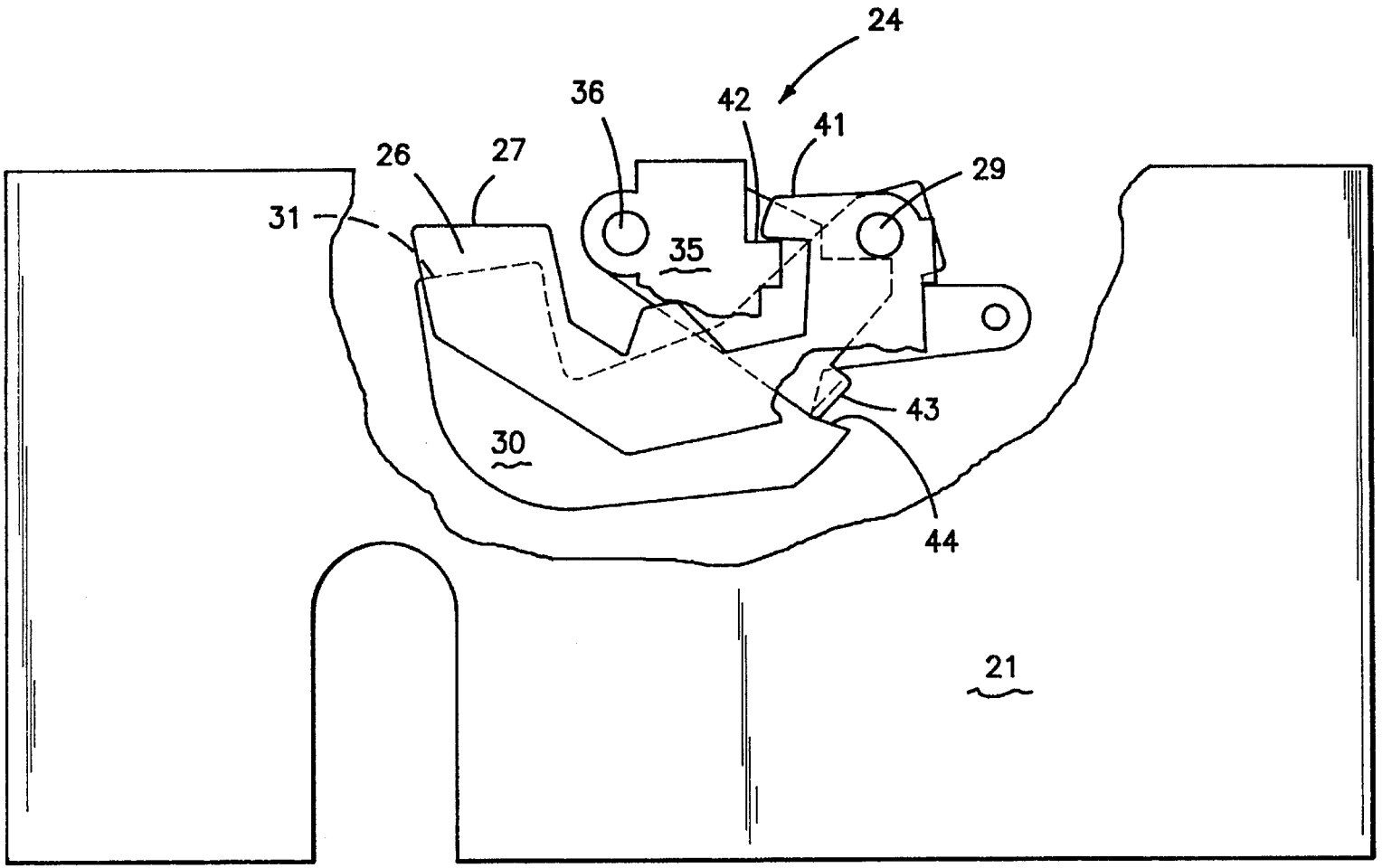
FIG. 4 is a partial side view of the externally-accessible interlock assembly of FIG. 3 depicting the operation of the opening lever therein.
Figure 5:
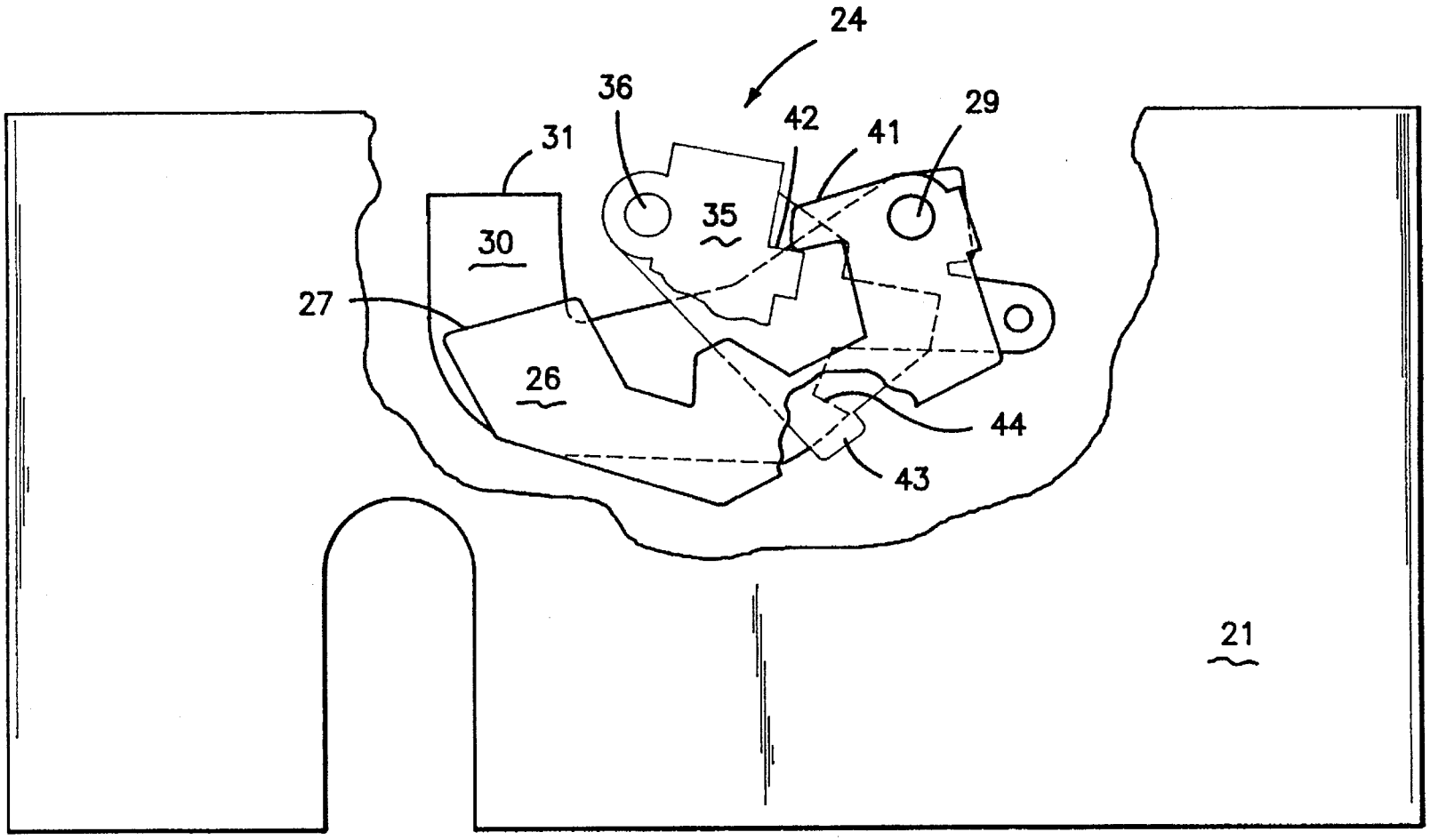
FIG. 5 is a partial side view of the externally-accessible interlock assembly of FIG. 3 depicting the operation of the closing lever therein.

The operation of the interlock assembly is best seen by referring now to FIGS. 4 and 5. In 4, the sideframe 21 is cut-away to show the operation of the opening lever 30 independent of the closing lever 26 by depressing the opening tab 31. The opening lever 30 rotates counter-clockwise about the common pivot 29 and positions the projection 44 extending from the bottom of the opening lever under the interlock tab 43 extending from the interlock link 35 which is pivotally arranged on the pivot shaft 36. This prevents the closing tab 27 from being depressed and the rotation of the closing lever 26 due to the corresponding capture of the projection 41 extending from the closing lever 26 against the interlock tab 42 extending from the interlock link 35. In FIG. 5, the closing tab 27 on the closing lever 26 is depressed rotating the closing lever 26 counter-clockwise about the common pivot 29 and positions the projection 41 extending from the closing lever 26 over the interlock tab 42 on the interlock link 35. This prevents the opening tab 31 from being depressed and the rotation of the opening lever 30 due to the corresponding capture of the projection 44 extending from the opening lever 30 against the interlock tab 43 extending from the interlock link 35.

In the event that both the closing tab 27 on the closing lever 26 and the opening tab 31 on the opening lever 30 are attempted to be depressed at the same time, there is a race to determine which of the projections 43, 44 on the corresponding levers will reach the associated lockout position first thereby preventing the other lever from rotating.

Although not shown, the opening and closing levers, 30, 26 are spring-biased back to their initial starting positions as soon as the associated opening and closing tabs, 31, 27 are released.

We claim:

1. An interlock assembly 24 for high ampere-rated circuit breaker operating mechanism assemblies comprising:

an opening lever 30 arranged for releasing charged opening springs within a circuit breaker operating mechanism;

a closing lever 26 arranged for releasing charged closing springs within said circuit breaker operating mechanism;

said opening lever comprises a shaped piece defining an opening tab 31 at one end and an opening lever projection 44 at an opposite end thereof, said closing lever comprises a shaped piece defining a closing tab 27 at one end and a closing lever projection 41 at an opposite end thereof, said opening lever and said closing lever are pivotally attached to a pair of sideframes 21, 22; and an interlock lever 35 interacting between said opening lever and said closing lever to thereby prevent simultaneous operation of said opening and closing levers, said interlock lever 35 is attached to said sideframes intermediate said opening lever and said closing lever, said interlock lever includes a first interlock tab 42 interacting with said closing lever projection to prevent rotation of said opening lever when said closing tab is first depressed.

2. The interlock assembly of claim 1 wherein said interlock lever includes a second interlock tab 43 interacting with said opening lever projection to prevent rotation of said closing lever when said opening tab is first depressed.

3. The interlock assembly of claim 1 wherein said opening lever and said closing lever are pivotally attached to said sideframes by a common pivot 29.

4. A circuit breaker comprising:

an insulative cover 14 attached to an insulative base;

an opening spring 20 within said cover arranged for opening circuit breaker contacts;

an opening button 31A on said cover and an opening lever 30 within said cover activating said opening spring;

a closing Spring 20' within said cover arranged for closing said circuit breaker contacts:

a closing button 27A on said cover and a closing lever 26 within said cover activating said closing spring;

an interlock lever 35 within said cover interacting with both said closing lever and said opening lever preventing activation of said closing spring and said opening spring at the same time, said opening lever comprises a shaped piece defining an opening tab 31 at one end and an opening lever projection 44 at an opposite end thereof, said closing lever comprises a shaped piece defining a closing tab 27 at one end and a closing lever projection 41 at an opposite end thereof, and said interlock lever includes a first interlock tab 42 interacting with said closing lever projection to prevent rotation of said opening lever when said closing tab is first depressed.

5. The circuit breaker of claim 4 wherein said opening lever and said closing lever are pivotally attached to a pair of sideframes by a common pivot 29.

* * * * *